US009998816B2

(12) United States Patent
Wilson

(10) Patent No.: US 9,998,816 B2
(45) Date of Patent: Jun. 12, 2018

(54) SYSTEM AND METHOD FOR RESTRAINING EAR-FITTING HEADPHONES

(71) Applicant: Andrew Wilson, Washington, DC (US)

(72) Inventor: Andrew Wilson, Washington, DC (US)

( * ) Notice: Subject to any disclaimer, the term of this patent is extended or adjusted under 35 U.S.C. 154(b) by 278 days.

(21) Appl. No.: 13/952,626

(22) Filed: Sep. 10, 2013

(65) Prior Publication Data

US 2015/0071476 A1 Mar. 12, 2015

(51) Int. Cl.

| | |
|---|---|
| ***H04R 25/00*** | (2006.01) |
| ***H04R 1/00*** | (2006.01) |
| ***H04R 1/10*** | (2006.01) |

(52) U.S. Cl.

CPC ..... *H04R 1/105* (2013.01); *H04R 1/10* (2013.01); *H04R 1/1058* (2013.01); *Y10T 29/49005* (2015.01)

(58) Field of Classification Search

CPC ..... H04R 1/105; Y10T 29/49005
USPC ..... 381/328, 361, 367, 370, 374, 376, 379, 381/381, 385, 380; 29/594
See application file for complete search history.

(56) References Cited

U.S. PATENT DOCUMENTS

| | | | | |
|---|---|---|---|---|
| 5,793,878 | A * | 8/1998 | Chang | 381/370 |
| 7,226,162 | B2 * | 6/2007 | Mah | 351/158 |
| 8,345,913 | B2 * | 1/2013 | Pang et al. | 381/384 |
| 2009/0141921 | A1 * | 6/2009 | Perkins et al. | 381/328 |
| 2010/0027824 | A1 * | 2/2010 | Atamaniuk et al. | 381/322 |
| 2010/0124349 | A1 * | 5/2010 | Bass | 381/379 |
| 2011/0091061 | A1 * | 4/2011 | von Dombrowski et al. | 381/330 |
| 2011/0110552 | A1 * | 5/2011 | Pang et al. | 381/374 |
| 2011/0261988 | A1 * | 10/2011 | Kromann et al. | 381/380 |

* cited by examiner

*Primary Examiner* — Khai N Nguyen

(57) ABSTRACT

An ear-fitting headphone restraint system includes an attachment assembly configured to be coupled to a portion of a stem of an ear-fitting headphone. The ear-fitting headphone is configured to be positioned against an ear canal of an ear. The system also includes a brace assembly coupled to the attachment assembly and configured to restrain the ear-fitting headphone against the ear canal by creating compression forces. The compression forces include a first compression force between the ear-fitting headphone and the ear canal. The compression forces further include a second compression force between a concha of the ear and the brace assembly. A first side of the brace assembly is configured to be positioned on a portion of the concha, and the attachment assembly is operable to transmit the first compression force and the second compression force between the brace assembly and the ear-fitting headphone.

19 Claims, 7 Drawing Sheets

SYSTEM AND METHOD FOR RESTRAINING EAR-FITTING HEADPHONES

BACKGROUND OF THE INVENTION

Field of the Invention

The disclosure relates generally to restraining headphones, and more particularly to restraining an earphone.

Description of Related Art

Consumer demand for mobile media experiences has created a market for peripheral devices designed to increase the convenience and mobility of existing portable electronic devices. Mobile entertainment devices are now expected to accommodate use during typical transportation methods (e.g., riding in planes, trains, and automobiles) and more mobile activities, such as, for example, walking, running, or working out.

Ear-fitting headphones are an important component in consumer enjoyment of mobile media devices. Device manufacturers often include free ear-fitting headphones with the purchase of their products and additionally market those headphones as stand-alone products. Advanced ear-fitting headphones marketed for a variety of specialized users are sold in the market. Such models are sometimes recommended for mobile or athletic users, and sometimes contain components that detect the user's speech for use in, as an example, mobile voice calling.

SUMMARY OF THE INVENTION

According to one embodiment, an ear-fitting headphone restraint system includes an attachment assembly configured to be coupled to a portion of a stem of an ear-fitting headphone. The ear-fitting headphone is configured to be positioned against an ear canal of an ear. The system also includes a brace assembly coupled to the attachment assembly and configured to restrain the ear-fitting headphone against the ear canal by creating compression forces. The compression forces include a first compression force between the ear-fitting headphone and the ear canal. The compression forces further include a second compression force between a concha of the ear and the brace assembly. A first side of the brace assembly is configured to be positioned on a portion of the concha, and the attachment assembly is operable to transmit the first compression force and the second compression force between the brace assembly and the ear-fitting headphone.

Other features and advantages of the present disclosure are apparent to persons of ordinary skill in the art in view of the following detailed description of the disclosure and the accompanying drawings.

BRIEF DESCRIPTION OF THE DRAWINGS

For a more complete understanding of the configurations of the present disclosure, needs satisfied thereby, and the features and advantages thereof, reference now is made to the following description taken in connection with the accompanying drawings.

DETAILED DESCRIPTION

Preferred embodiments of the present invention, and their features and advantages, may be understood by referring to FIGS. 1-7, like numerals being used for corresponding parts in the various drawings.

Figure 1:
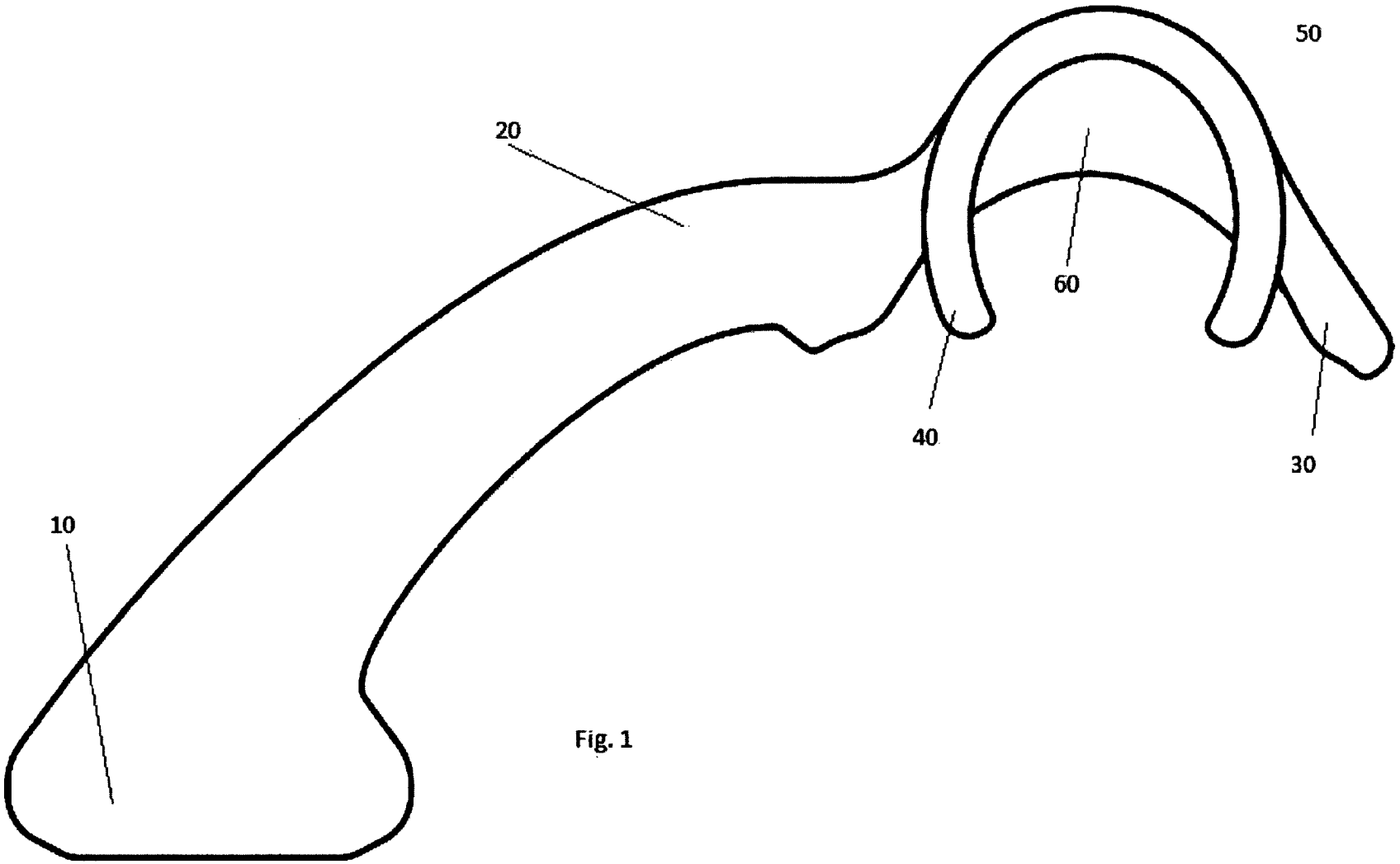
FIG. 1 illustrates a back view of a system for restraining an ear-fitting headphone in accordance with one non-limiting embodiment of the present disclosure.

According to FIG. 1, a back view of an ear-fitting headphone restraint system is illustrated in accordance with one particular non-limiting embodiment of the present disclosure. In certain embodiments, an ear-fitting headphone restraint system includes an attachment assembly 50 and a brace assembly 10. Attachment assembly 50 is configured to attach to the stem portion of an ear-fitting headphone, e.g., an earbud, and/or earpod. Brace assembly 10 is configured to secure the ear-fitting headphone in the ear canal of a user by pressing against, lodging against, and/or sitting on a concha of the ear of the user. An adjustment assembly 20 may connect the brace assembly to the attachment assembly and may be configurable to different lengths such that the brace assembly may comfortably fit in a variety of users' ears.

For example, the embodiment illustrated in FIG. 1, is configured to attach to the left ear-fitting headphone in a set of ear-fitting headphones. Attachment flange 40 and base attachment surface 60 hug portions of the ear-fitting headphone such that attachment assembly 50 clips to the stem of the ear-fitting headphone.

In certain embodiments, the user attaches the ear-fitting headphone restraint system to an ear-fitting headphone and places the headphone in the user's ear. For example, a user places the left earphone with the ear-fitting headphone restraint system attached into the user's ear. The user may twist the restraint system downwards in order to secure the restraint system and the headphone into the user's ear.

In certain embodiments, headphone head support mechanism 30 hugs a side of the head portion of the headphone in order to prevent the headphone restraint system from rotating. For example, when the attached device is placed in a user's ear, a rotating force may be applied around the stem of the headphone and on the sides of the head of the earphone by the restraint systems. Headphone head support mechanism 30 hugs the head portion of the headphone in order to prevent the restraint system from rotating, and keeping the restraint system in place.

In certain embodiments, headphone head support mechanism 30 may be configurable to fit to a variety of different headphones.

In certain embodiments, sound quality is enhanced by directing the headphone's natural and/or designed sound direction into the user's ear. For example, certain headphones have a particular speaker direction. The speaker direction may become dislodged from the user's ear during physical movements of the user. In certain embodiments, the headphone restraint system lodges in the user's ear and directs the sound from the headphone into the user's ear as designed.

In certain embodiments, an ear-fitting headphone refers to any headphone that is designed to cover, fit in, fit on, wrap around, or be place on a user's ear. Attachment assembly 50 may be configured to fit on a variety of headphones. In certain embodiments, attachment assembly is configured to attach to several different brands and/or types of headphones in one unit.

In certain embodiments, headphones include one or more of ear-fitting headphones, earbuds, in-ear headphones, telephone handset earphones, ambient noise reduction headphones, and any other type of headphone.

In certain embodiments, attachment assembly 50 includes a clip, such that attachment flanges 40 fit on and attach to a variety of headphone stems.

Figure 2:
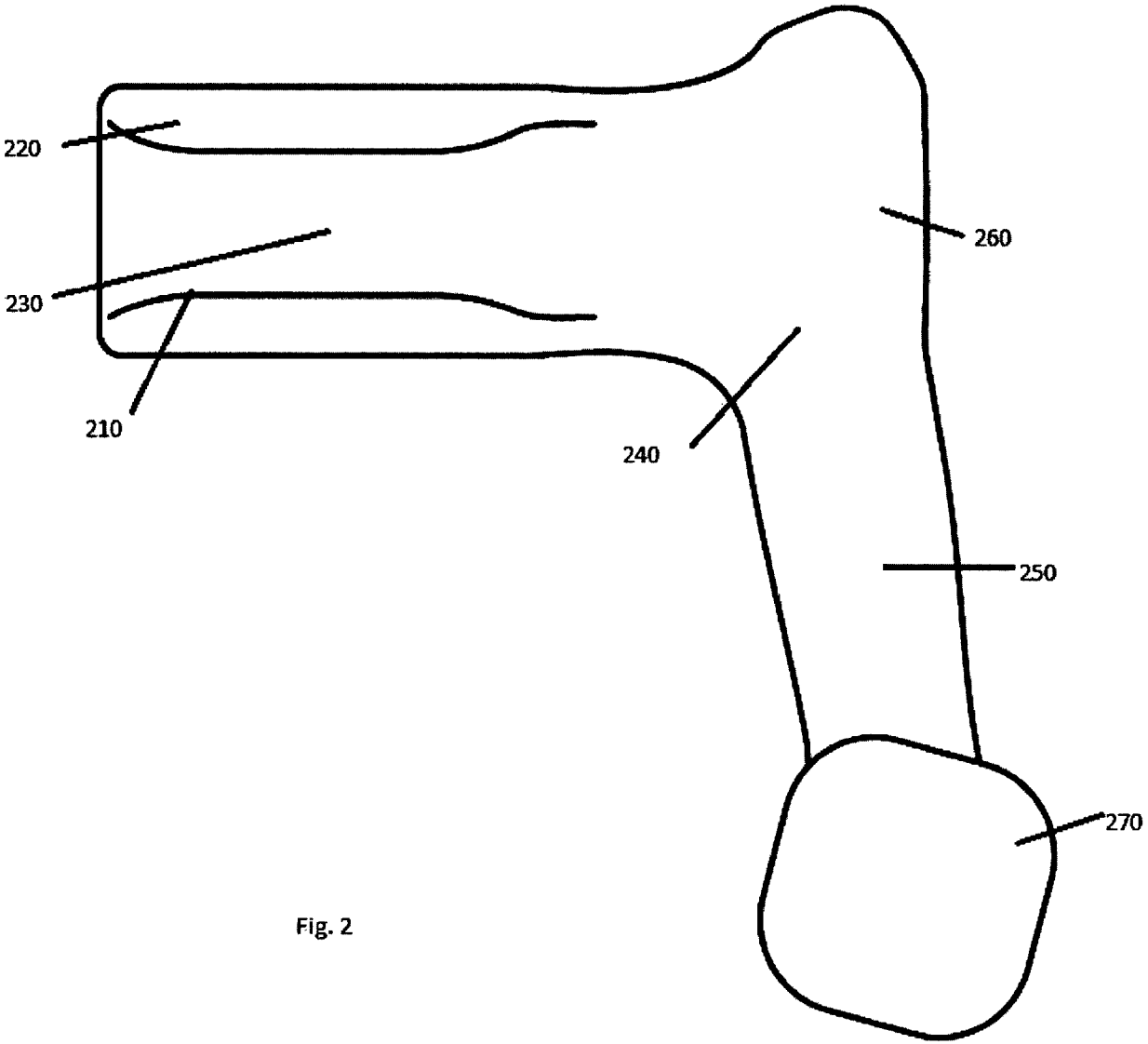
FIG. 2 illustrates a back view of a system for restraining an ear-fitting headphone in accordance with one non-limiting embodiment of the present disclosure.

Referring to FIG. 2, a back view of a system for restraining an ear-fitting headphone is illustrated in accordance with a non-limiting embodiment of the present disclosure. In certain embodiments, attachment flanges 210 and 230 snap to the stem of a headphone. For example, the headphone may be an ear-fitting headphone and/or an earbud style headphone.

In certain embodiments, attachment flanges 210 and 230 may be adjustable. In certain embodiments, attachment flanges 210 and 230 are included in a clip assembly that may open to accommodate a variety of headphone stems and clamp down to attach to the headphone stem. For example, a clip and/or clamp assembly includes attachment flanges 210 and 230. The clip and/or clamp assembly is configured to attach to a variety of headphone stems.

Headphone head support mechanisms 260 and 240 may be configured to hug the head portion of a headphone such that the attachment assembly and restraint system is fixedly coupled to the headphone.

Adjustment assembly 250 may connect the attachment assembly and brace assembly and may transmit compression forces between components when positioned in a user's ear. For example, adjustment assembly 250 may be a solid piece of plastic that couples the attachment assembly and brace assembly. As another example, adjustment assembly 250 may be configured by the user to fit to his or her specific ear size. As an example, the user may extend or contract the length of adjustment assembly. A user with a larger space between the concha and ear canal may extend the length of adjustment assembly 250. A user with a smaller space between the concha and ear canal may decrease the length of adjustment assembly 250.

In certain embodiments, adjustment assembly 250 includes a spring, such that the compressive force generated between the attachment assembly and the brace assembly is cushioned by the spring of adjustment assembly 250. Such a configuration may provide the user with more comfort.

Figure 3:
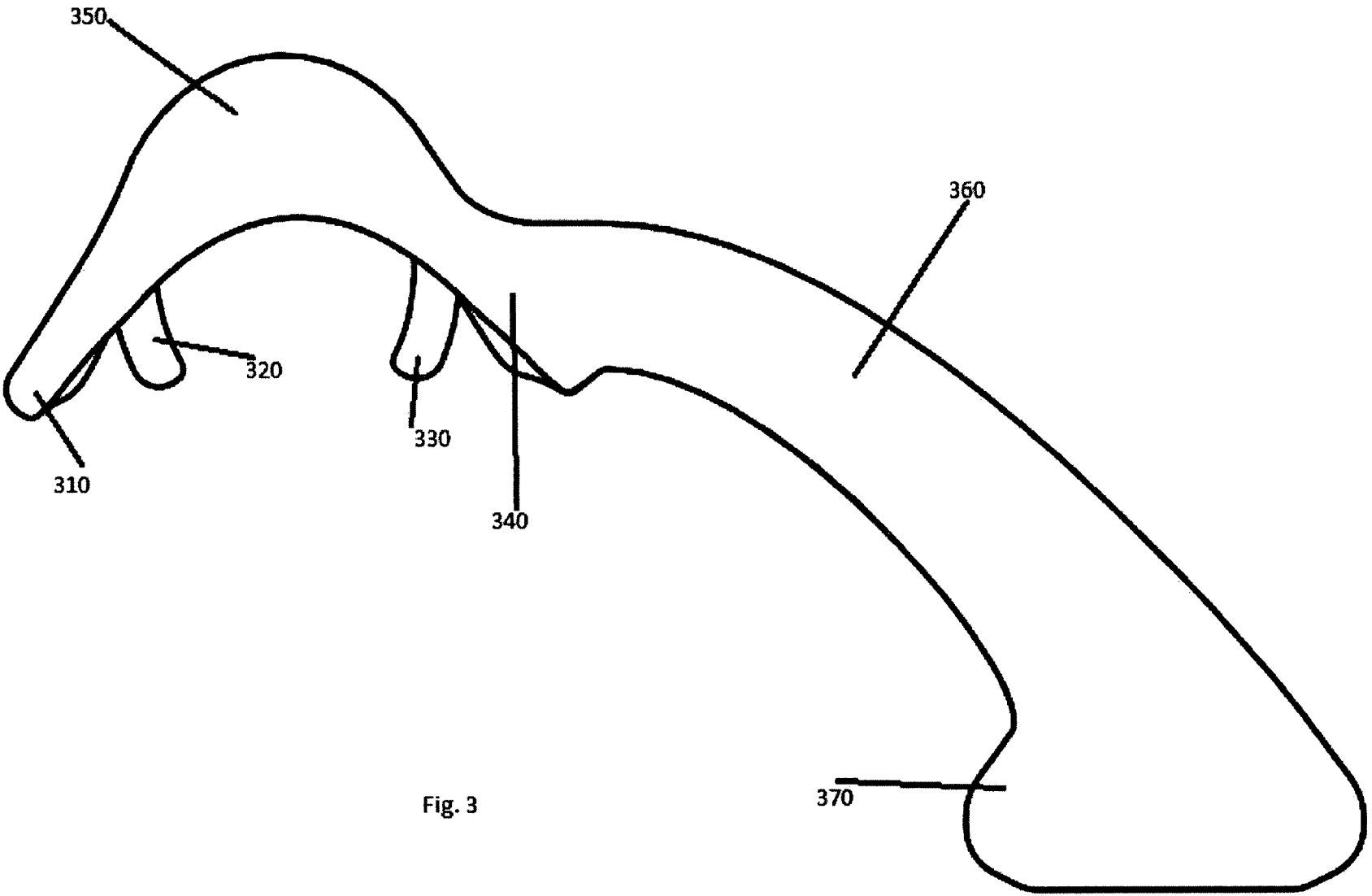
FIG. 3 illustrates a front view of a system for restraining an ear-fitting headphone in accordance with one non-limiting embodiment of the present disclosure.

FIG. 3 illustrates a front view of a system for restraining an ear-fitting headphone with compression. In certain embodiments, attachment flanges 320 and 330 are configured to clip to the stem of a headphone to hold the system in place on the headphone. Adjustment assembly 360 couples brace assembly 370 to the attachment assembly and relays compressive forces between the brace assembly and the attachment assembly.

Figure 4:
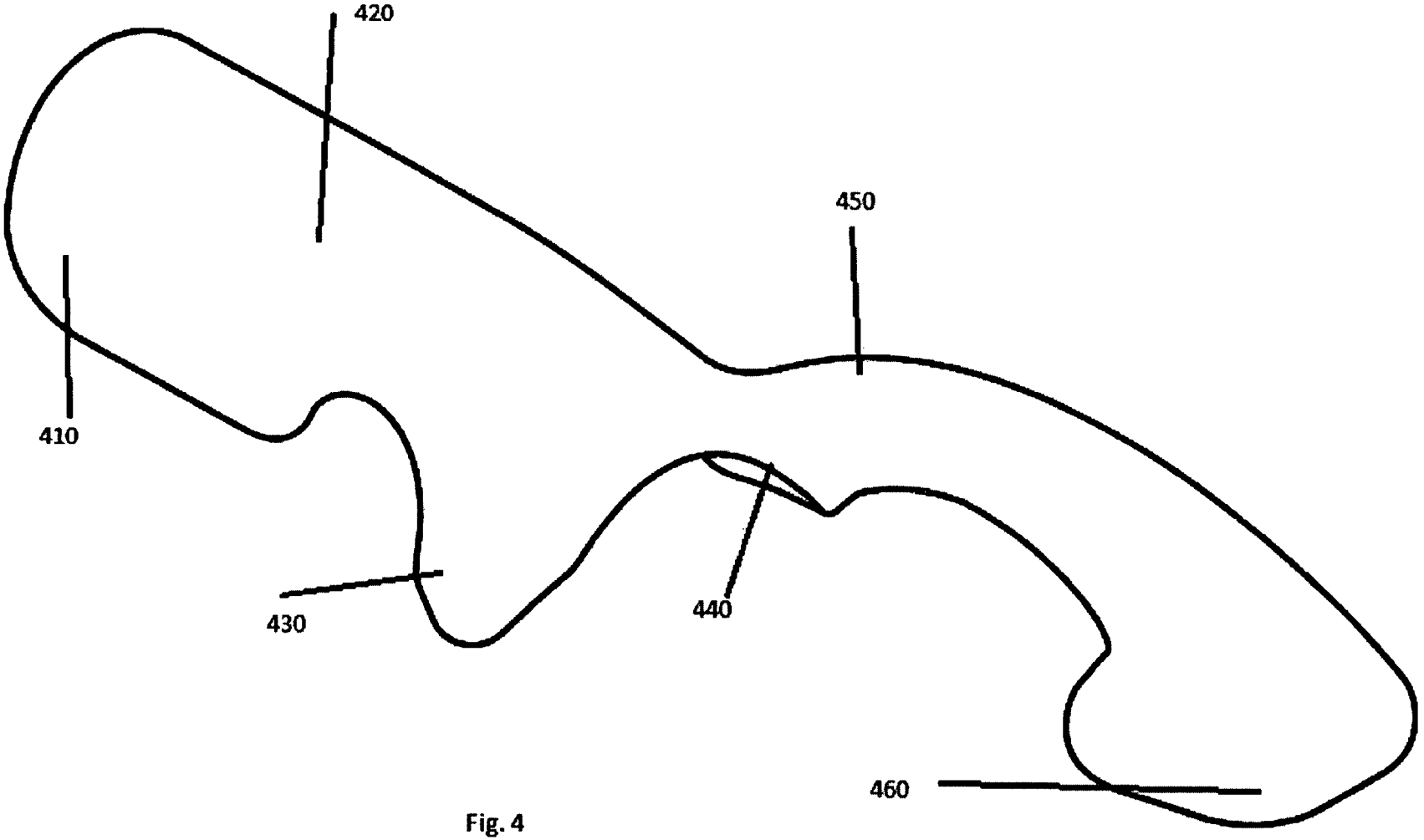
FIG. 4 illustrates an isometric view of a system for restraining an ear-fitting headphone in accordance with one non-limiting embodiment of the present disclosure.

FIG. 4 illustrates an isometric view of a system for restraining an ear-fitting headphone in accordance with a non-limiting embodiment of the present disclosure. In certain embodiments, adjustment assembly 450 is made of a flexible material to provide a cushioned fit for brace assembly 460 lodged in the concha of the ear. In certain embodiments, brace assembly 460 is made of a soft flexible material.

In certain embodiments, a user attaches the system for restraining ear-fitting headphones to the stem of an ear-fitting headphone. The system is then inserted into the user's ear with the brace assembly tilted slightly upwards such that the system fits between the concha of the ear and the ear canal. The brace assembly is then rotated down such that the brace assembly comes in contact with the lower portion of the concha. The head of the earphone is thus held in place in the user's ear. In certain embodiments, the headphone may be designed to maintain a certain orientation in the user's ear. The system for restraining ear-fitting headphones may help the headphone maintain that position during physical activity.

In certain embodiments, a clip includes a single piece assembly configured to snap on and/or clip onto an object, for example, a stem of a headphone.

Figure 5:
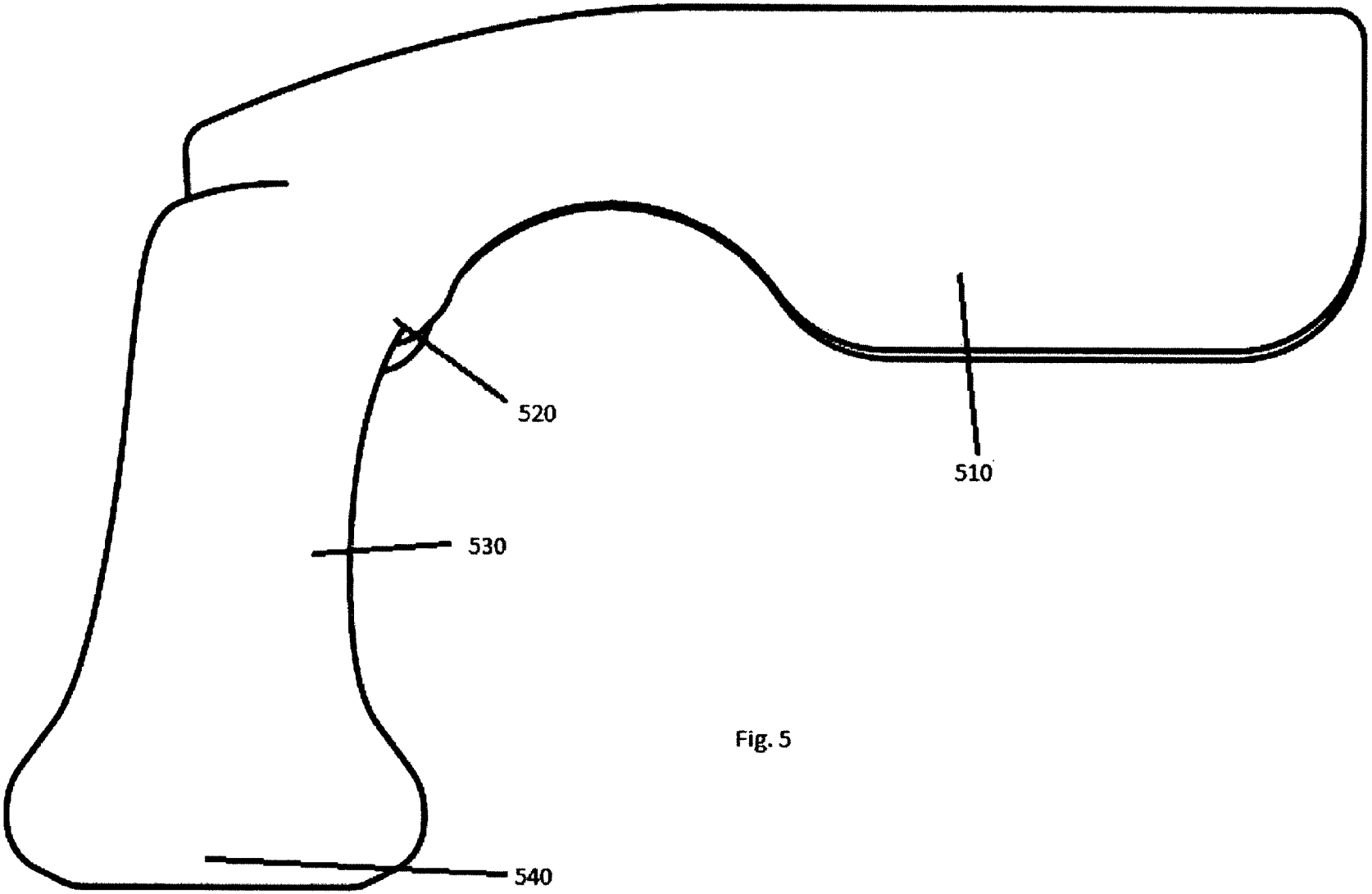
FIG. 5 illustrates a right side view of a system for restraining an ear-fitting headphone in accordance with one non-limiting embodiment of the present disclosure.

FIG. 5 illustrates a right side view of a system for restraining an ear-fitting headphone in accordance with one non-limiting embodiment of the present disclosure.

Figure 6:
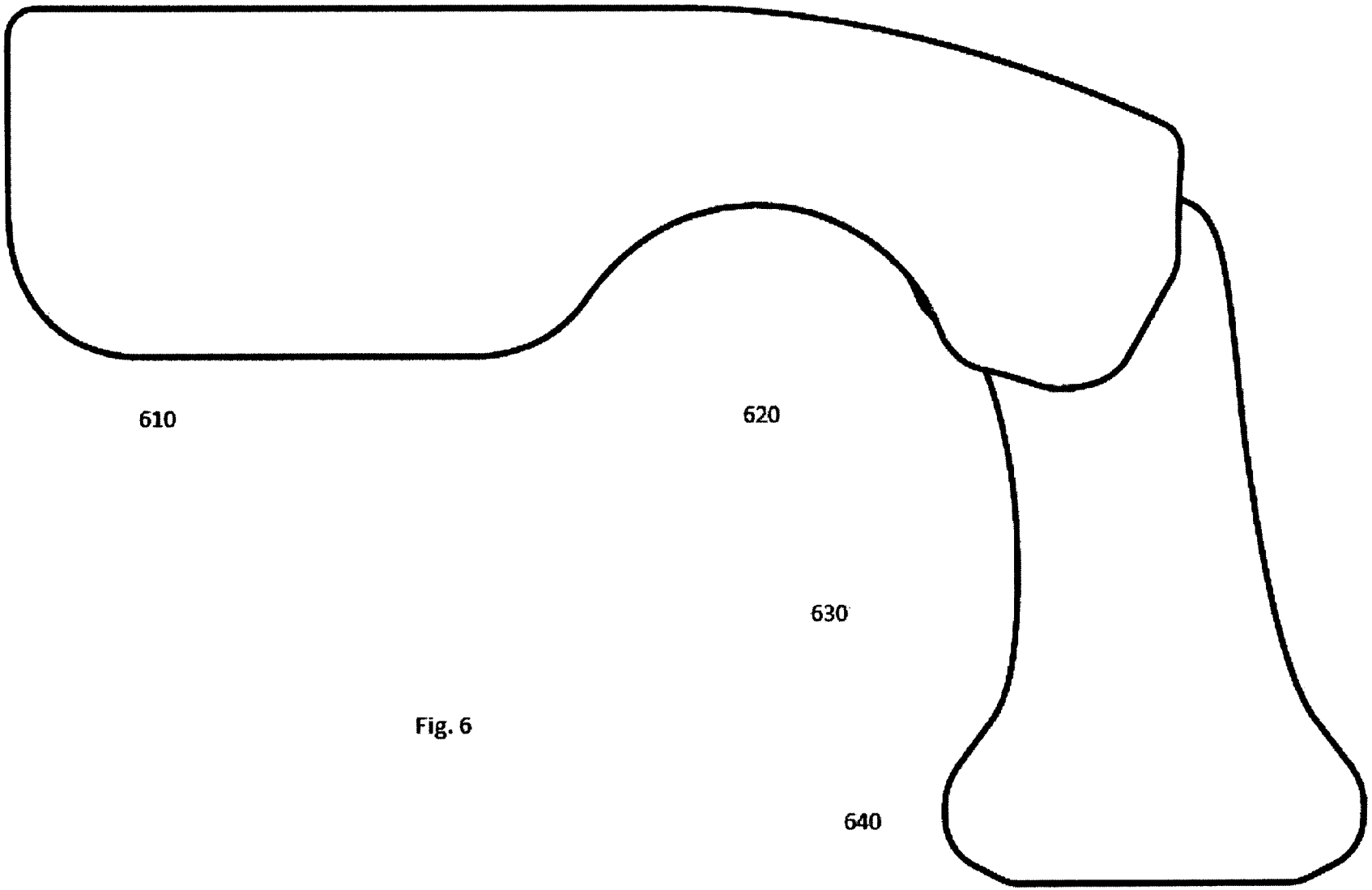
FIG. 6 illustrates a left side view of a system for restraining an ear-fitting headphone in accordance with one non-limiting embodiment of the present disclosure.

FIG. 6 illustrates a left side view of a system for restraining an ear-fitting headphone in accordance with one non-limiting embodiment of the present disclosure.

Figure 7:
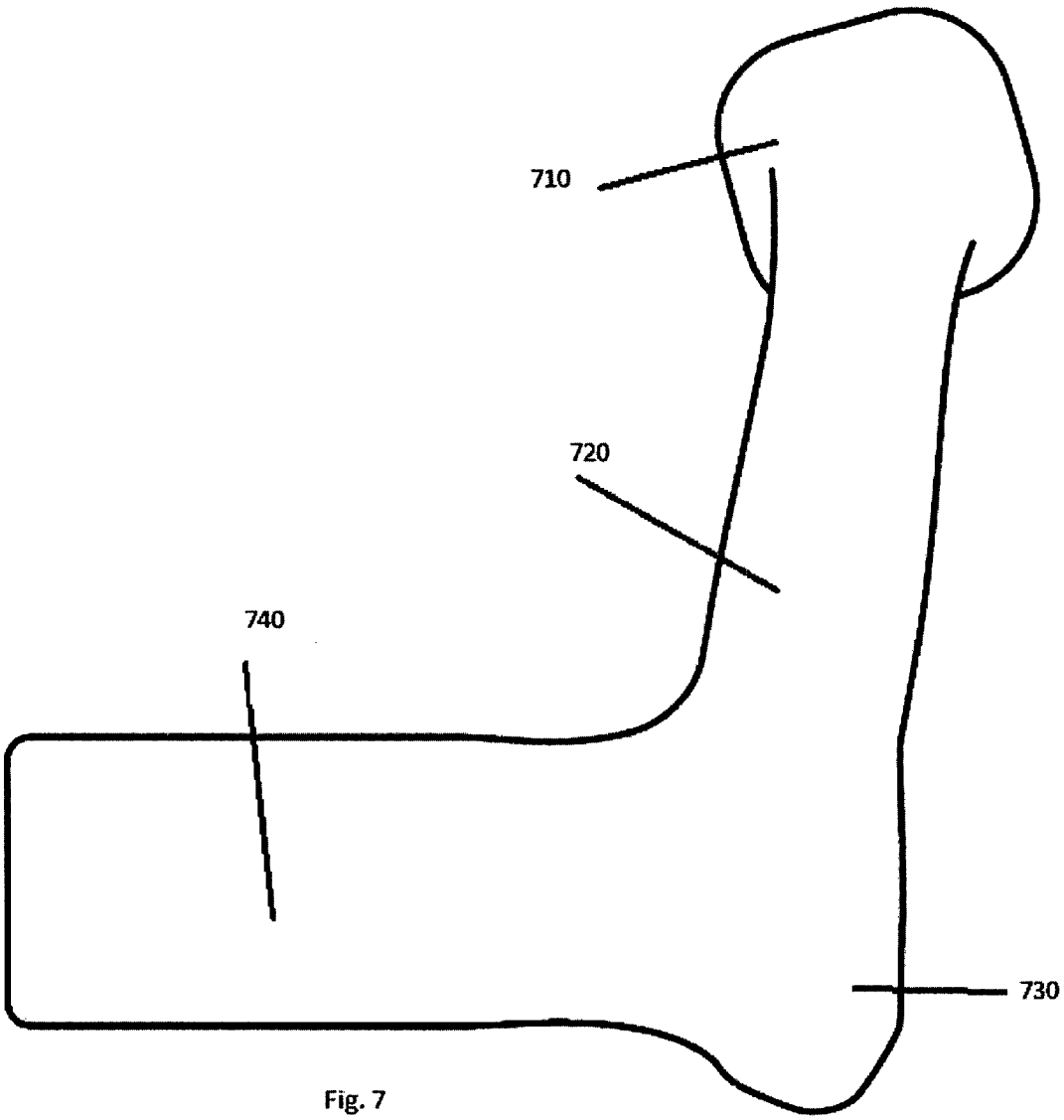
FIG. 7 illustrates a top view of a system for restraining an ear-fitting headphone in accordance with one non-limiting embodiment of the present disclosure.

FIG. 7 illustrates a top view of a system for restraining an ear-fitting headphone in accordance with one non-limiting embodiment of the present disclosure.

While the disclosure has been described in connection with various configurations, it will be understood by those of ordinary skill in the art that other variations and modifications of the various configurations described above may be made without departing from the scope of the disclosure. Other configurations will be apparent to those of ordinary skill in the art from a consideration of the specification or practice of the configurations of the disclosure disclosed herein. The specification and the described examples are considered as exemplary only, with the true scope and spirit of the configurations of the disclosure indicated by the following claims.

What is claimed is:

1. An ear-fitting headphone restraint system, comprising:

an attachment assembly configured to be coupled to a portion of a stem of an ear-fitting headphone, wherein the ear-fitting headphone is configured to be positioned against an ear canal of an ear; and a brace assembly coupled to the attachment assembly and configured to restrain the ear-fitting headphone against the ear canal by creating compression forces, the compression forces comprising:

a first compression force between the ear-fitting headphone and the ear canal; and a second compression force between a concha of the ear and the brace assembly;

wherein a first side of the brace assembly is configured to be positioned on a portion of the concha, and the attachment assembly is operable to transmit the first compression force and the second compression force between the brace assembly and the ear-fitting headphone.

2. The system of claim 1, further comprising an adjustment assembly disposed between a second side of the brace assembly and the attachment assembly, wherein the adjustment assembly is configured to couple the brace assembly and the attachment assembly.

3. The system of claim 2, wherein the adjustment assembly is configured to receive adjustments to the relative orientation and position of the attachment assembly and the brace assembly.

4. The system of claim 1, wherein the attachment assembly comprises a clip that is operable to receive the portion of the stem and couple the attachment assembly to the stem.

5. The system of claim 1, wherein interior surfaces of the attachment assembly are configured to conform to the contours of the portion of the stem.

6. The system of claim 1, wherein the brace assembly comprises a length adjustment component, wherein the length adjustment component is configured to control the distance between the first side of the brace assembly and the second side of the brace assembly.

7. The system of claim 1, wherein the brace assembly comprises a spring assembly disposed between the first and second side of the brace assembly, and wherein the force comprises a spring force.

8. The system of claim 1, wherein the attachment assembly is further configured to snap to the stem of the ear-fitting headphone.

9. A method comprising:

receiving, at an attachment assembly, a first compression force, the first compression force created between an ear-fitting headphone and an ear canal of an ear, wherein the attachment assembly is detachably attached to a portion of the ear-fitting headphone;

receiving a second compression force between a concha of the ear and a brace assembly, the brace assembly being coupled to an attachment assembly; and transmitting the first compression force and the second compression force between the brace assembly and the ear-fitting headphone to restrain the ear-fitting headphone in the ear.

10. The method of claim 9, wherein the brace assembly and the attachment assembly are coupled by an adjustment assembly, wherein the adjustment assembly is disposed between a first side of the brace assembly and the attachment assembly.

11. The method of claim 10, wherein the adjustment assembly is configured to adjust the relative orientation and position of the brace assembly and the attachment assembly.

12. The method of claim 9, wherein the attachment assembly comprises a clip, and wherein the attachment assembly is detachably attached to the portion of the stem with the clip.

13. The method of claim 9, wherein the brace assembly comprises a length adjustment component configured to control the distance between the first side of the brace assembly and a second side of the brace assembly, the second side of the brace assembly disposed against a portion of the concha of the ear.

14. An ear-fitting headphone restraint system, comprising:

an attachment assembly configured to be coupled to a portion of a stem of an ear-fitting headphone, wherein the ear-fitting headphone is configured to be positioned against an ear canal of an ear, and wherein the ear-fitting headphone is an external device; and a brace assembly coupled to the attachment assembly and configured to restrain the ear-fitting headphone against the ear canal by creating compression forces, the compression forces comprising:

a first compression force between the ear-fitting headphone and the ear canal; and a second compression force between a concha of the ear and the brace assembly;

wherein a first side of the brace assembly is configured to be positioned on a portion of the concha, and the attachment assembly is operable to transmit the first compression force and the second compression force between the brace assembly and the ear-fitting headphone.

15. The system of claim 14, further comprising an adjustment assembly disposed between a second side of the brace assembly and the attachment assembly, wherein the adjustment assembly is configured to couple the brace assembly and the attachment assembly.

16. The system of claim 15, wherein the adjustment assembly is configured to receive adjustments to the relative orientation and position of the attachment assembly and the brace assembly.

17. The system of claim 14, wherein the attachment assembly comprises a clip that is operable to receive the portion of the stem and couple the attachment assembly to the stem.

18. The system of claim 14, wherein interior surfaces of the attachment assembly are configured to conform to the contours of the portion of the stem.

19. The system of claim 14, wherein the brace assembly comprises a length adjustment component, wherein the length adjustment component is configured to control the distance between the first side of the brace assembly and the second side of the brace assembly.

* * * * *